US012193525B2

(12) United States Patent
Mastrella et al.

(10) Patent No.: US 12,193,525 B2
(45) Date of Patent: Jan. 14, 2025

(54) FOLDED-WING BRASSIERE AND METHOD OF CONSTRUCTION

(71) Applicant: Retail Royalty Company, Las Vegas, NV (US)

(72) Inventors: Lauren Mastrella, Floral Park, NY (US); Lyndsey Stocker, Brooklyn, NY (US); Andrea Jagaric, Greenwich, CT (US); Lora Levi, Brooklyn, NY (US)

(73) Assignee: Retail Royalty Company, Las Vegas, NV (US)

( * ) Notice: Subject to any disclaimer, the term of this patent is extended or adjusted under 35 U.S.C. 154(b) by 65 days.

(21) Appl. No.: 17/338,801

(22) Filed: Jun. 4, 2021

(65) Prior Publication Data

US 2022/0007748 A1 Jan. 13, 2022

Related U.S. Application Data

(60) Provisional application No. 63/051,239, filed on Jul. 13, 2020.

(51) Int. Cl.
*A41C 3/12* (2006.01)
*A41C 3/00* (2006.01)

(52) U.S. Cl.
CPC ..... *A41C 3/12* (2013.01); *A41C 3/0014* (2013.01)

(58) Field of Classification Search
CPC ..... A41C 3/0014
See application file for complete search history.

(56) References Cited

U.S. PATENT DOCUMENTS

| | | | | | |
|---|---|---|---|---|---|
| 2,049,569 | A * | 8/1936 | Price | A41C 3/00 2/22 |
| D103,068 | S | 2/1937 | Rosenthal | |
| D109,778 | S | 5/1938 | Abeles | |
| D115,705 | S | 7/1939 | Kaufman | |
| D130,376 | S | 11/1941 | Amyot | |
| 2,425,145 | A * | 8/1947 | Coleman | A41C 3/00 D2/708 |
| D159,148 | S | 6/1950 | Gimble | |
| 3,411,510 | A * | 11/1968 | Child | A41C 3/00 450/74 |

(Continued)

FOREIGN PATENT DOCUMENTS

| | | | | |
|---|---|---|---|---|
| CN | 110771962 | A | 2/2020 | |
| EP | 1033084 | A2 * | 9/2000 | A41B 9/04 |
| WO | WO-2021081893 | A1 * | 5/2021 | |

OTHER PUBLICATIONS

Lingerie Glossary. Chantelle, May 19, 2019. https://us.chantelle.com/glossary/ (Year: 2019).*

(Continued)

*Primary Examiner* — Grace Huang
(74) *Attorney, Agent, or Firm* — Wood Herron & Evans LLP

(57) ABSTRACT

A bra wing includes a base material, a fold edge, and a bonding material. A fold in the base material creates the fold edge, an inner base material layer, and an outer base material layer. The inner base material layer and the outer base material layer are joined with the bonding material to create a 2-ply structure. A bra includes the bra wing, a first cup, and a second cup. Methods of constructing the bra wing are also disclosed.

20 Claims, 7 Drawing Sheets

(56) References Cited

U.S. PATENT DOCUMENTS

| | | | | |
|---|---|---|---|---|
| 6,572,437 | B1 * | 6/2003 | Waitz | A41C 3/00 450/1 |
| D487,541 | S | 3/2004 | Ledein | |
| 6,779,367 | B2 | 8/2004 | Mitchell et al. | |
| 6,817,214 | B2 * | 11/2004 | Rabinowicz | A41C 3/00 450/156 |
| 6,966,815 | B2 * | 11/2005 | Weinerth | A41C 3/142 450/39 |
| 7,192,332 | B2 * | 3/2007 | Liu | A41C 3/122 450/39 |
| 7,198,540 | B2 * | 4/2007 | Liu | A41C 3/0014 450/39 |
| 7,309,276 | B2 * | 12/2007 | Legaspi | A41C 3/10 450/41 |
| D571,529 | S | 6/2008 | Cook | |
| D587,878 | S | 3/2009 | Higo et al. | |
| D608,979 | S | 2/2010 | Wayns | |
| 7,854,022 | B2 * | 12/2010 | Warren | A41B 9/001 2/401 |
| D632,458 | S | 2/2011 | Shirer | |
| 7,927,180 | B2 * | 4/2011 | Simpson | A41C 3/12 450/1 |
| 7,959,487 | B2 * | 6/2011 | Simpson | A41C 3/12 450/39 |
| 7,963,822 | B2 | 6/2011 | Simpson | |
| 7,967,658 | B2 * | 6/2011 | Simpson | A41C 5/00 450/39 |
| 8,066,546 | B2 * | 11/2011 | Simpson | A41D 27/24 450/74 |
| 8,388,406 | B2 | 3/2013 | Liu | |
| 8,556,677 | B2 * | 10/2013 | Allen | A41C 3/00 450/39 |
| 9,149,080 | B2 * | 10/2015 | Zhang | A41F 1/006 |
| 9,210,955 | B2 * | 12/2015 | Dandapure | A41C 5/005 |
| D798,531 | S | 10/2017 | Dacumos | |
| D798,532 | S | 10/2017 | Dacumos | |
| D798,533 | S | 10/2017 | Dacumos | |
| D804,779 | S | 12/2017 | Shaham | |
| 10,123,574 | B2 * | 11/2018 | Wilson | A41C 3/0021 |
| 10,314,344 | B2 * | 6/2019 | Wittstadt | A41C 3/0035 |
| 10,368,590 | B2 * | 8/2019 | Diaz | A41C 3/0085 |
| 10,638,800 | B2 * | 5/2020 | Hoeven | A41C 5/005 |
| 11,241,048 | B2 * | 2/2022 | Alva | A41C 3/0035 |
| 11,612,193 | B2 * | 3/2023 | Dowdle | A41B 17/00 450/93 |
| 2006/0003668 | A1 * | 1/2006 | Aerts | B32B 37/1207 450/39 |
| 2006/0281389 | A1 * | 12/2006 | Liu | A41C 3/0014 450/1 |
| 2007/0123146 | A1 * | 5/2007 | Wan | A41C 5/00 450/1 |
| 2008/0153388 | A1 * | 6/2008 | Liu | A41C 3/00 450/39 |
| 2008/0280530 | A1 * | 11/2008 | Simpson | A41C 3/12 450/39 |
| 2010/0035514 | A1 | 2/2010 | Wong et al. | |
| 2015/0011141 | A1 * | 1/2015 | Gasco-Buisson | A41C 1/003 450/156 |
| 2015/0079876 | A1 * | 3/2015 | Betts | A41C 3/0057 450/78 |
| 2018/0310641 | A1 | 11/2018 | Melendez et al. | |
| 2019/0133206 | A1 | 5/2019 | Azan et al. | |
| 2022/0273050 | A1 * | 9/2022 | Martinet | A41C 3/128 |

OTHER PUBLICATIONS

"Stretch and Recovery Adhesives." Bemis. https://www.bemisworldwide.com/products/stretch-recovery-adhesives/ (Year: 2023).*

"FAQ." Bemis. https://www.bemiswolrdwide.com/frequently-asked-questions/ (Year: 2023).*

"Search results—Adhesive." Bemis. https://www.bemisworldwide.com/?s=adhesive (Year: 2023).*

* cited by examiner

FOLDED-WING BRASSIERE AND METHOD OF CONSTRUCTION

CROSS-REFERENCE TO RELATED APPLICATION

This application claims the benefit of and priority to U.S. Provisional Application No. 63/051,239 filed Jul. 13, 2020, the disclosure of which is incorporated by reference herein in its entirety.

TECHNICAL FIELD

This disclosure relates generally to brassieres (hereinafter referred to as a "bra"), and more particularly to bra wings with a reduced amount of traditional hem. The disclosure further relates to a method for constructing a bra wing with a reduced amount of traditional hem.

BACKGROUND

Bra designs can vary wildly, with functional or aesthetic goals driving the variations. Despite the variations, bras generally encompass cups to support a woman's bust and wings that serve to sustain the cups against the bust. Additionally, straps are often implemented into a bra design to aid in the sustainment of the cups. These bra components are joined and shaped using seams that traditionally have been created with stitches but may now also be created with techniques such as ultrasonic welding and adhesive-based bonding solutions. Seams often incorporate an elastic-type material or inherently include an elastic-type characteristic, either of which provides a high stretch capability that can help make a bra more comfortable.

At the same time, however, seams detract from the comfort of wearing a bra. Their added bulk relative to what they are joining can create different pressure points against the skin when the bra is being worn. This discomfort presented by seams is tolerated, nevertheless, because the seams provide functional support for the bra. For example, seams along the perimeter of a bra's wings serve to maintain the wings shape which in turn aids to disperse the force needed to support the bust across the area of the wings. This support is achieved despite the seams along the upper perimeter of the bra's wings having a tendency, due to their bulk, to rub (i.e., create a point of high friction) against the skin of both the torso and arms, causing discomfort.

Seams also tend to be aesthetically unappealing. The added bulk the seams create is very often visible through the garment layer being worn over the bra.

Advances in seam techniques, such as ultrasonic welding, have enabled a reduction in seam bulk, thereby improving the comfort and aesthetic appeal while maintaining desired functional support, which can include an elastic-type characteristic. Nevertheless, these advances have not eliminated the presence of a seam, and therefore have not eliminated all the discomfort and unappealing aesthetics caused by the seam.

Accordingly, what is desired is a bra that reduces the number of seams required, particularly at points of high friction, to provide a smoother (i.e., invisible) effect and more comfortable feel when being worn while maintaining the supporting benefit, which includes the high stretch capability, that seams provide.

SUMMARY

A bra wing is disclosed. The bra wing includes a base material, a fold edge, and a bonding material. A fold in the base material creates the fold edge, an inner base material layer, and an outer base material layer. The inner base material layer and the outer base material layer are joined with the bonding material to create a 2-ply structure.

In an exemplary embodiment, the bra wing further includes a top edge along the upper perimeter of the bra wing, a bottom edge along the lower perimeter of the bra wing; and a ballet back edge along the side perimeters of the bra wing. Additionally, the fold edge is the top edge.

In a further embodiment, the 2-ply structure covers the surface area of the bra wing. In yet another embodiment, the bra wing includes an overhang along the bottom edge and an overhang along the ballet back edge.

In an exemplary embodiment, the overhang along the bottom edge is the portion of the outer base material layer extending beyond the inner base material layer at the bottom edge. Also, the overhang along the ballet back edge is the portion of the outer base material layer extending beyond the inner base material layer at the ballet back edge.

In another embodiment, the overhang along the bottom edge is the portion of the inner base material layer extending beyond the outer base material layer at the bottom edge. Similarly, the overhang along the ballet back edge is the portion of the inner base material layer extending beyond the outer base material layer at the ballet back edge.

In still a further embodiment, the bottom edge is hemmed using the overhang along the bottom edge. Likewise, the ballet back edge is hemmed using the overhang along the ballet back edge.

In an exemplary embodiment, the base material is a fabric. In another embodiment, the bonding material is a laminate film adhesive. Further, the laminate film adhesive may possess a stretch and recovery ability.

In one embodiment, the bra wing includes a fastening mechanism for securing the bra wing. The fastening mechanism may be a hook and eye fastener.

In another embodiment, a bra includes the bra wing, a first cup, and a second cup. The bra may also include two straps.

In yet another embodiment, a method of constructing a bra wing from a base material and a bonding material includes folding the base material to create a fold edge, a plurality of non-fold edges, an inner base material layer, and outer base material layer, and joining the inner base material layer and the outer base material layer with the bonding material to create a 2-ply structure. In one embodiment, the fold edge is along the upper perimeter of the bra wing.

In an exemplary embodiment, the method of constructing a bra wing from a base material and a bonding material further includes removing a first portion of the 2-ply structure along the fold edge sized to receive a first cup and removing a second portion of the 2-ply structure along the fold edge sized to receive a second cup. The method further includes hemming the plurality of non-fold edges and attaching a fastening mechanism.

BRIEF DESCRIPTION OF THE DRAWINGS

The accompanying drawings are included to provide a further understanding and are incorporated in and constitute a part of this specification. The drawings illustrate one or more embodiment(s), and together with the description serve to explain principles and operation of the various embodiments. Features and attributes associated with any of the embodiments shown or described may be applied to other embodiments shown, described, or appreciated based on this disclosure.

DETAILED DESCRIPTION

In the following detailed description of several illustrative embodiments, reference is made to the accompanying drawings that form a part hereof, and in which is shown by way of illustration, a specific preferred embodiment in which the invention may be practiced. These embodiments are described in sufficient detail to enable those skilled in the art to practice the invention, and it is understood that other embodiments may be utilized, and that logical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Figure 1:
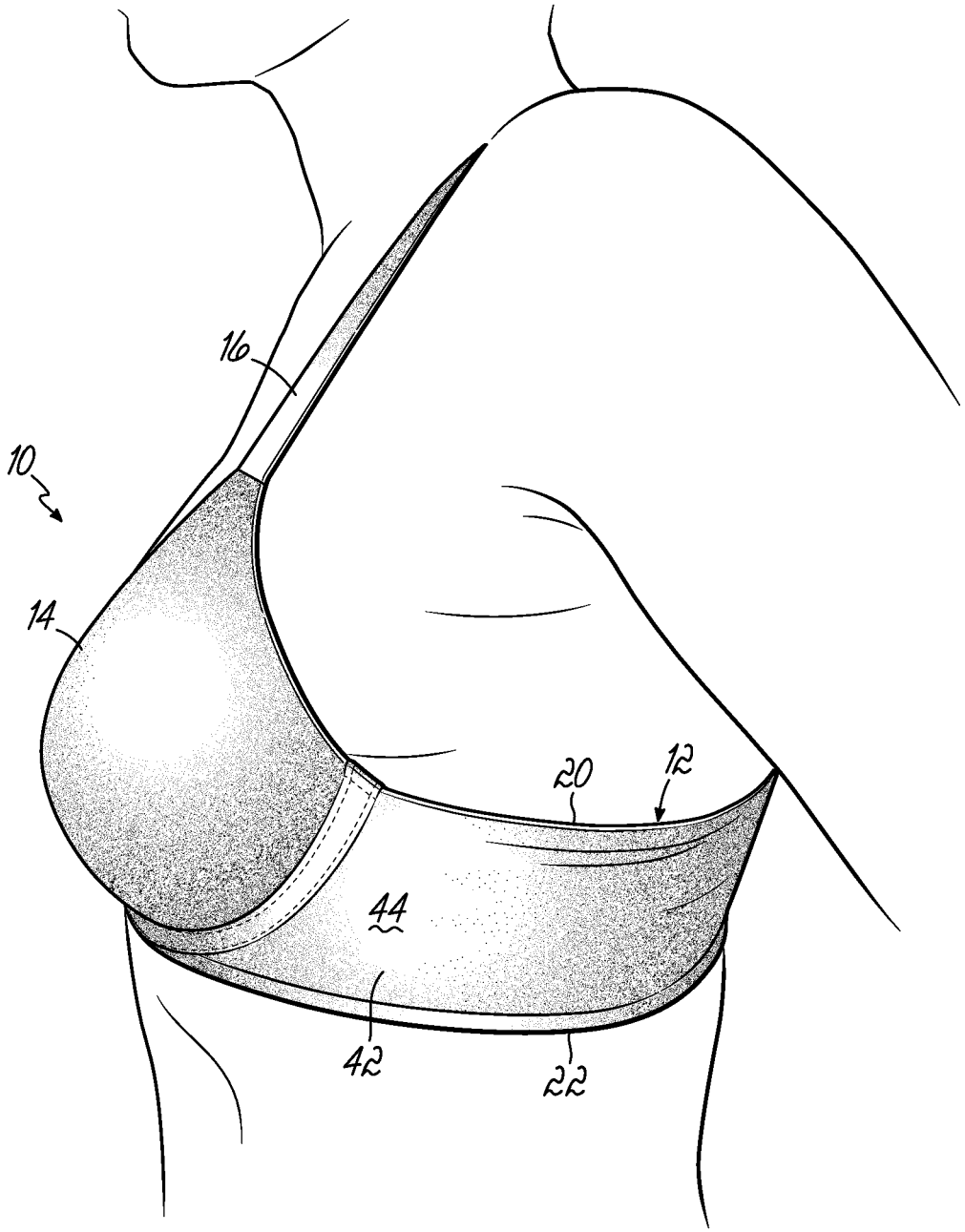
FIG. 1 is an on-body right perspective view of a bra according to an exemplary embodiment of the disclosure.
Figure 2:
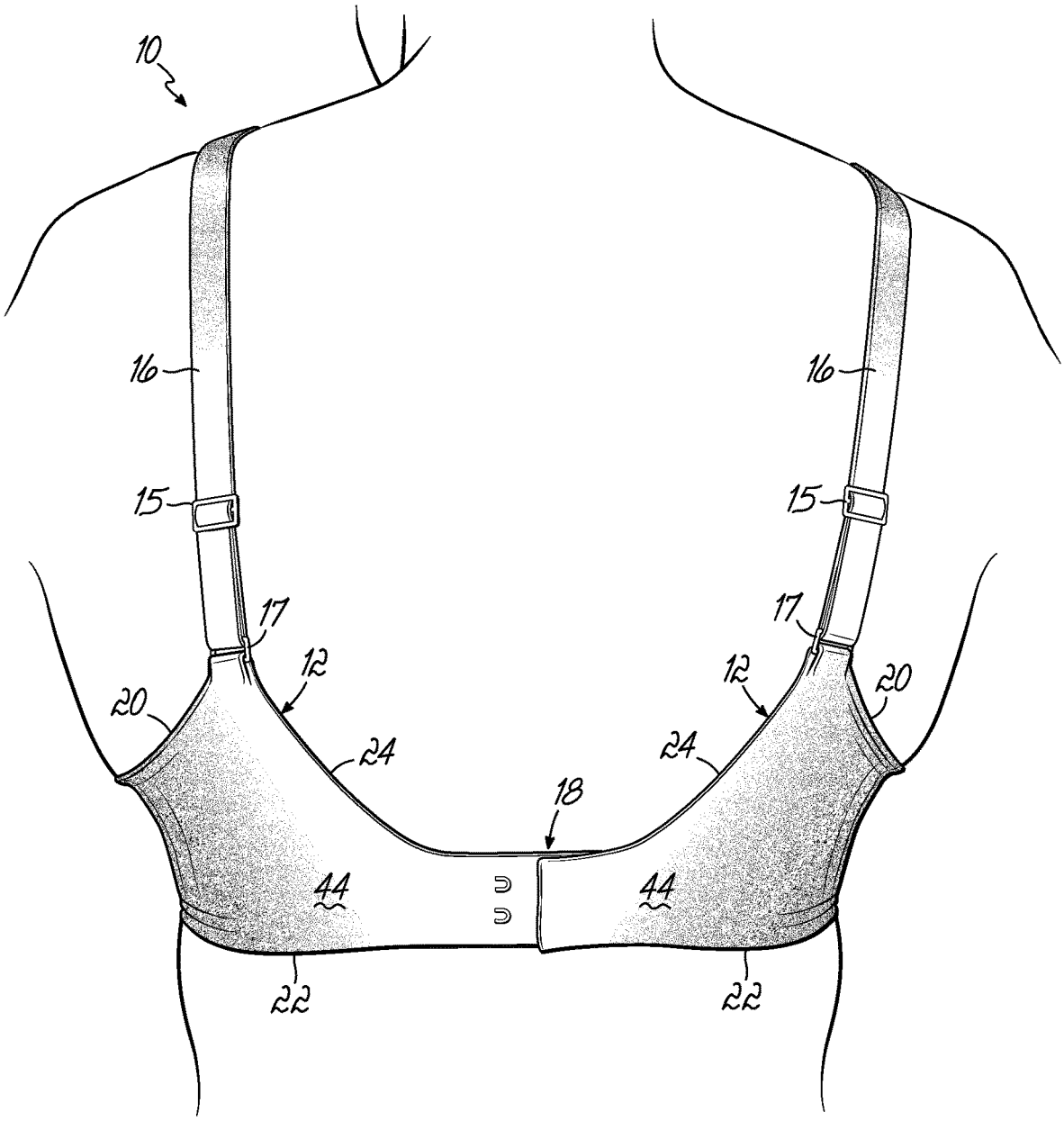
FIG. 2 is an on-body rear perspective view of the bra of FIG. 1.

FIGS. 1 and 2 are perspective views of a bra 10 while on a user's body, with FIG. 1 depicting a right perspective of the bra 10 and FIG. 2 a rear perspective of the bra 10, in accordance with an exemplary embodiment of the invention. The bra 10 may include a wing 12, two cups 14, and two straps 16. The wing 12 may further include a fastener 18. In a preferred embodiment, the fastener 18 is a hook and eye fastening system. Additionally, the wing 12 may be a single piece that is capable of being wrapped around the user. In alternative embodiments the wing 12 may instead be comprised of multiple pieces (e.g., a left and right wing, or a left, rear, and right wing) that are joined together upon construction of the bra 10. Construction of the wing 12 is discussed in detail with FIGS. 3-7 below.

The cups 14 of the present invention may be of a molded and lightly lined full coverage floating construction and may further provide a clean finish neckline and underarm. Use of floating construction provides an increase in adjustability of the cups 14. The cups 14 may also incorporate the use of a flexible underwire in its construction (not shown). This is in contrast to traditional underwires that are firm and do not change shape. Alternative embodiments of the invention may include different sizes, including unequal sizes for each of the cups 14. The straps 16 may be constructed out of continuous elastic, with printed silicone alphanumeric characters and/or figures on the elastic. In addition, the straps 16 may include strap adjusters 15 to assist with proper fitting of the bra 10. The strap adjusters 15 may be constructed or molded from colored (e.g., silver, rose gold) metal or plastic. However, the cups 14 and the straps 16 may be constructed in other ways, consistent with those understood by a person of ordinary skill in the art, without departing from the present invention.

Joining of the wing 12, the cups 14, and the straps 16 may be achieved in various ways that are known to those skilled in the art. In a preferred embodiment, the seam between each of the cups 14 and the wing 12 may be made using traditional stitching (e.g., bar tack, straight, machine basting, zigzag, lightning) along the lower portion of the cup. The upper portion of each of the cups 14 may also connect to a respective strap 16 using traditional stitching. Other methods of joining, such as with ultrasonic welding, may be used without departing from the present invention.

As shown in FIG. 2, the non-stitched end of the straps 16 may attached to the wing 12 via rings 17. The rings 17 may be constructed or molded from a colored (e.g., silver, rose gold) metal or plastic. Each strap 16 may be looped through a ring 17 and double back to a strap adjuster 15. The rings 17 may be joined to the wing 12 during the construction of the wing 12, which is discussed below. Alternatively, the rings 17 may be joined to the wing 12 after wing construction, by traditional stitching that may include an additional patch of fabric or use the available hem of the wing 12.

FIGS. 3-5A are perspective views of the bra according to an embodiment of the invention and will be used principally to describe the wing 12. In the preferred embodiment, the wing 12 is comprised primarily of a single piece of fabric, which is folded to create a 2-ply wing. Said another way, the wing 12 is constructed so that no seam or hem is required along a portion of the wing while still permitting the wing 12 to have a 2-ply structure. Each ply is hereafter identified as the outer fabric layer 42 and the inner fabric layer 32. Additionally, the wing 12 may be constructed without traditional elastic material.

Figure 3:
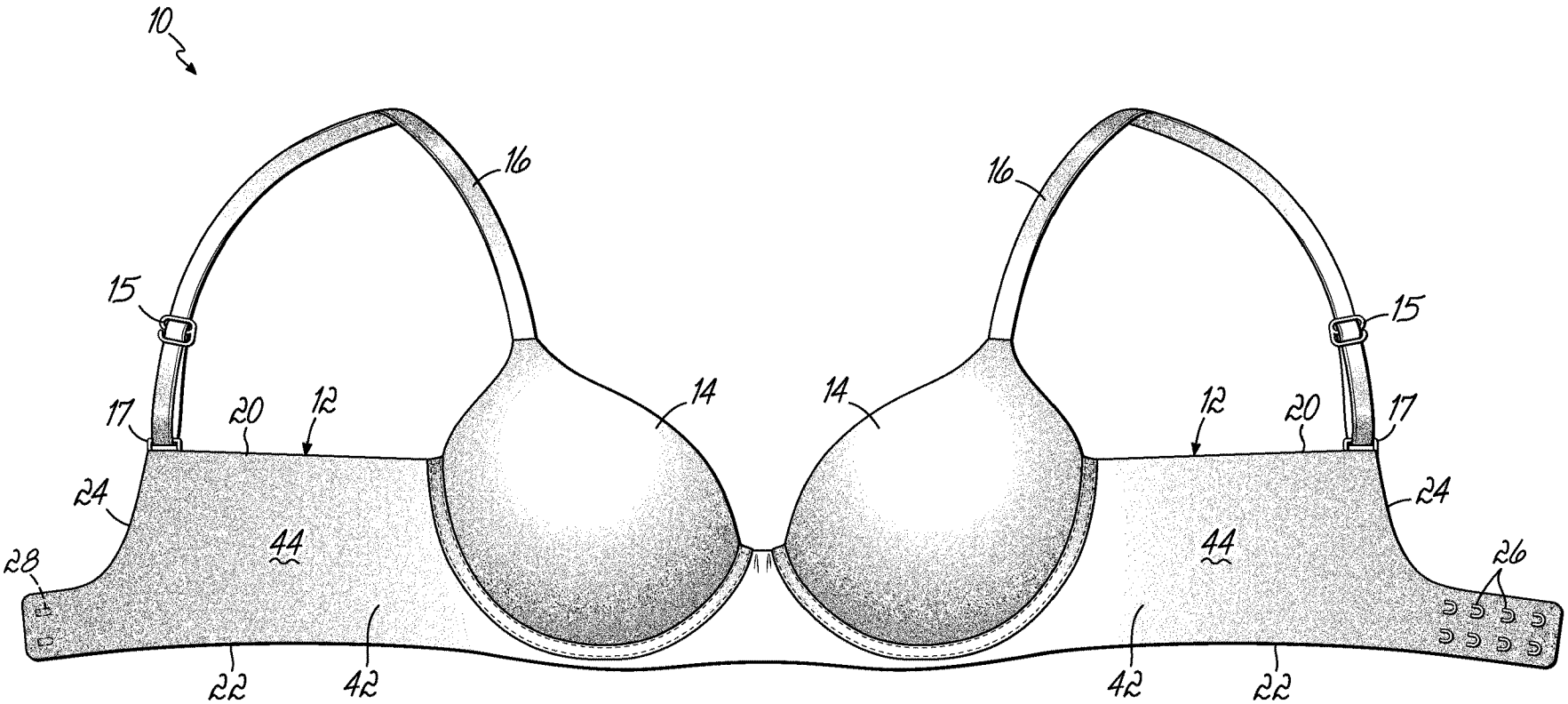
FIG. 3 is an off-body front perspective view of a bra in an unclasped position in accordance with one embodiment of the disclosure.

In FIG. 3, an off-body front perspective of the wing 12, the wing fold 20 is shown in the upper perimeter of the wing 12. The 2-ply structure may have sections removed along the wing fold 20 to accommodate joining of the cups 14. The removal of these sections may leave behind a smaller fold in the upper portion of the centre front. The remaining perimeter of the wing 12, that which is not joined to each of the cups 14, is hemmed. The wing bottom hem 22 and wing ballet back hems 24 identify these sections of the perimeter. In the front perspective presented in FIG. 3, the outer fabric layer 42, and more specifically the outer fabric layer external surface 44, is visible.

Figure 4:
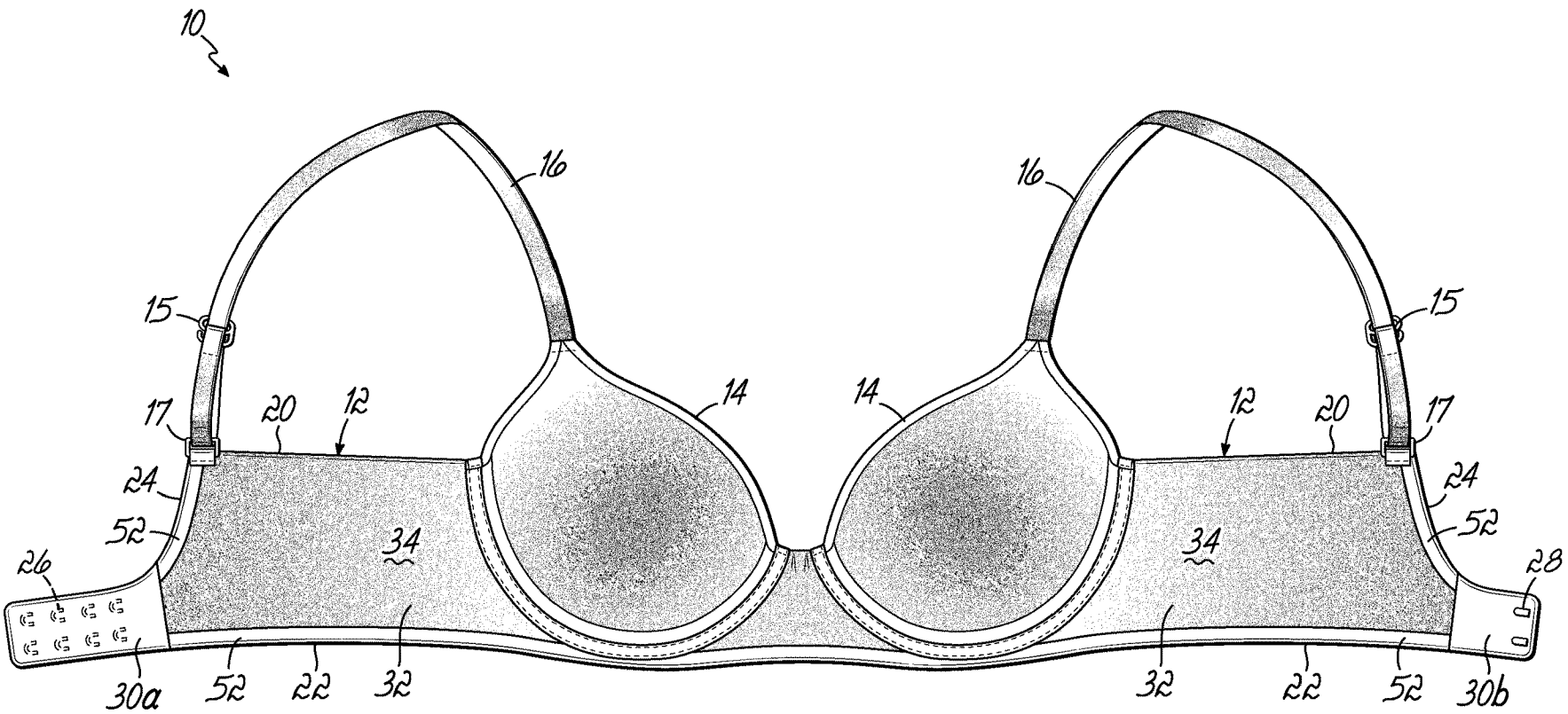
FIG. 4 is an off-body rear perspective view of the bra of FIG. 3.

FIG. 4 is an off-body rear perspective of the wing 12. In this view, the inner fabric layer 32, and more specifically the inner fabric layer external surface 34, is visible. Also in this view, the outer fabric layer overhang 52 of the wing bottom hem 22 and the wing ballet back hems 24 are visible. The construction of both the wing bottom hem 22 and the wing ballet back hems 24 is discussed with FIGS. 6 and 7 below. Embodiments of the invention may include a rigid stabilizer bonded against the inner centre front cradle (not shown) using a seam-creating technique such as ultrasonic welding.

The hook and eye fastening system used for the fastener 18 is also seen in FIG. 4. The fastener 18 is comprised of an eye patch 30*a* and a hook patch 30*b*, with a plurality of eyes 26 extending from the eye patch 30*a* and a plurality of hooks 28 extending from the hook patch 30*b*. The eye patch 30*a* may be sized at a standard length (e.g., 1¼") in order to include multiple points of fastening the plurality of hooks 28. Both the eyes 26 and hooks 28 attach to their respective patches by methods known by those of ordinary skill in the art. Also, both the eye patch 30*a* and the hook patch 30*b* are cushioned and are joined to the wing 12 primarily along the wing bottom hem 22 and the wing ballet back hems 24. The joining may be done via traditional stitching or utilize more contemporary techniques such as ultrasonic welding. Additionally, upon being joined to the wing 12, the plurality of eyes 26 traverse the wing 12 so as to extend out of the outer fabric layer external surface 44. In this fashion the eyes 26 may engage with the hooks 28 upon the bra 10 being worn. Requisite hardware for the fastener 18—the eyes 26 and the hooks 28 in the present embodiment—may be constructed or molded from a colored (e.g., silver, rose gold) metal or plastic. Alternative embodiments may include other fastening systems (e.g., zipper, buttons, fabric ties) without departing from the present invention.

Figure 5A:
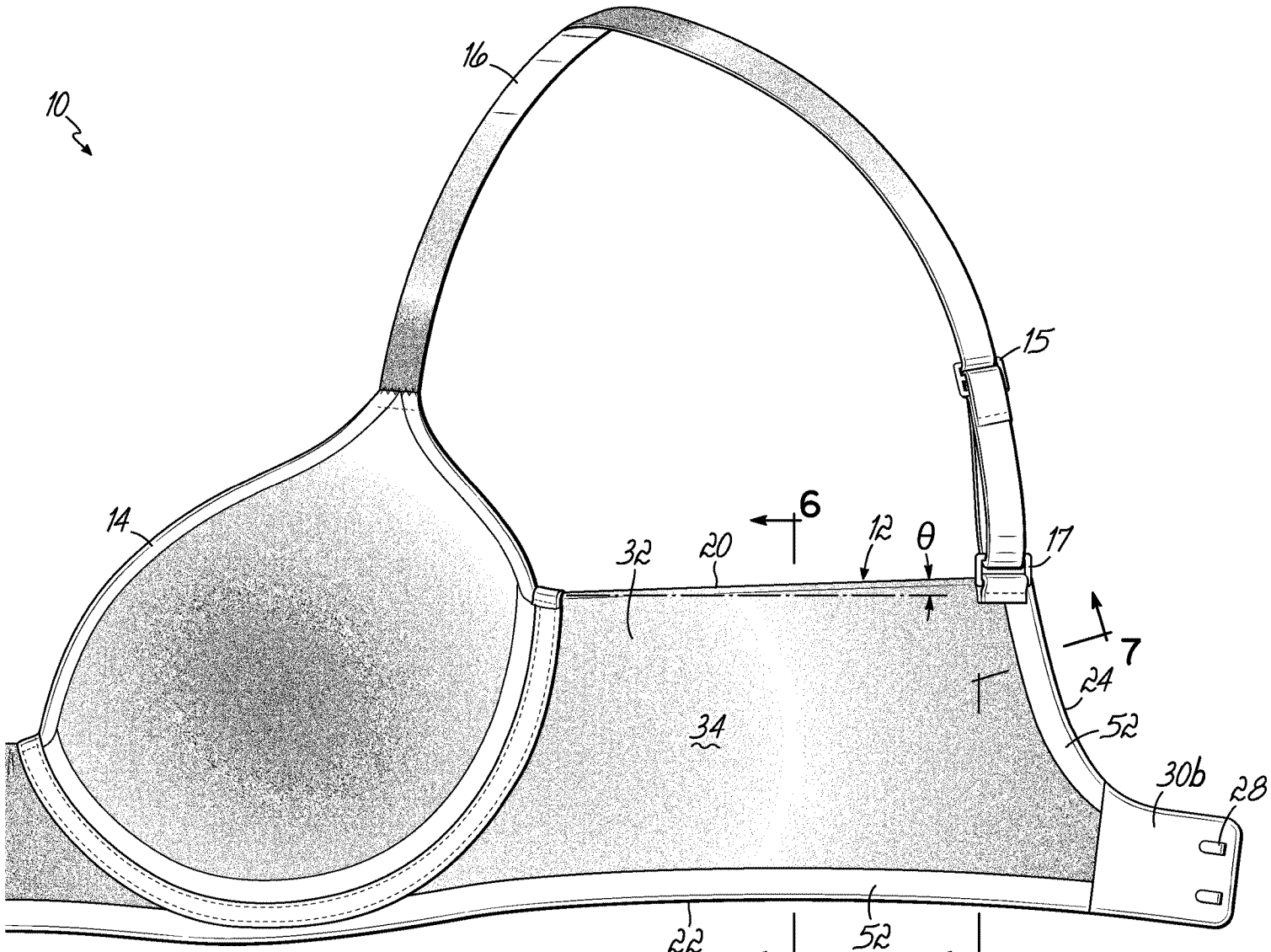
FIG. 5A is a partial, enlarged view of the bra of FIG. 4.
Figure 5B:
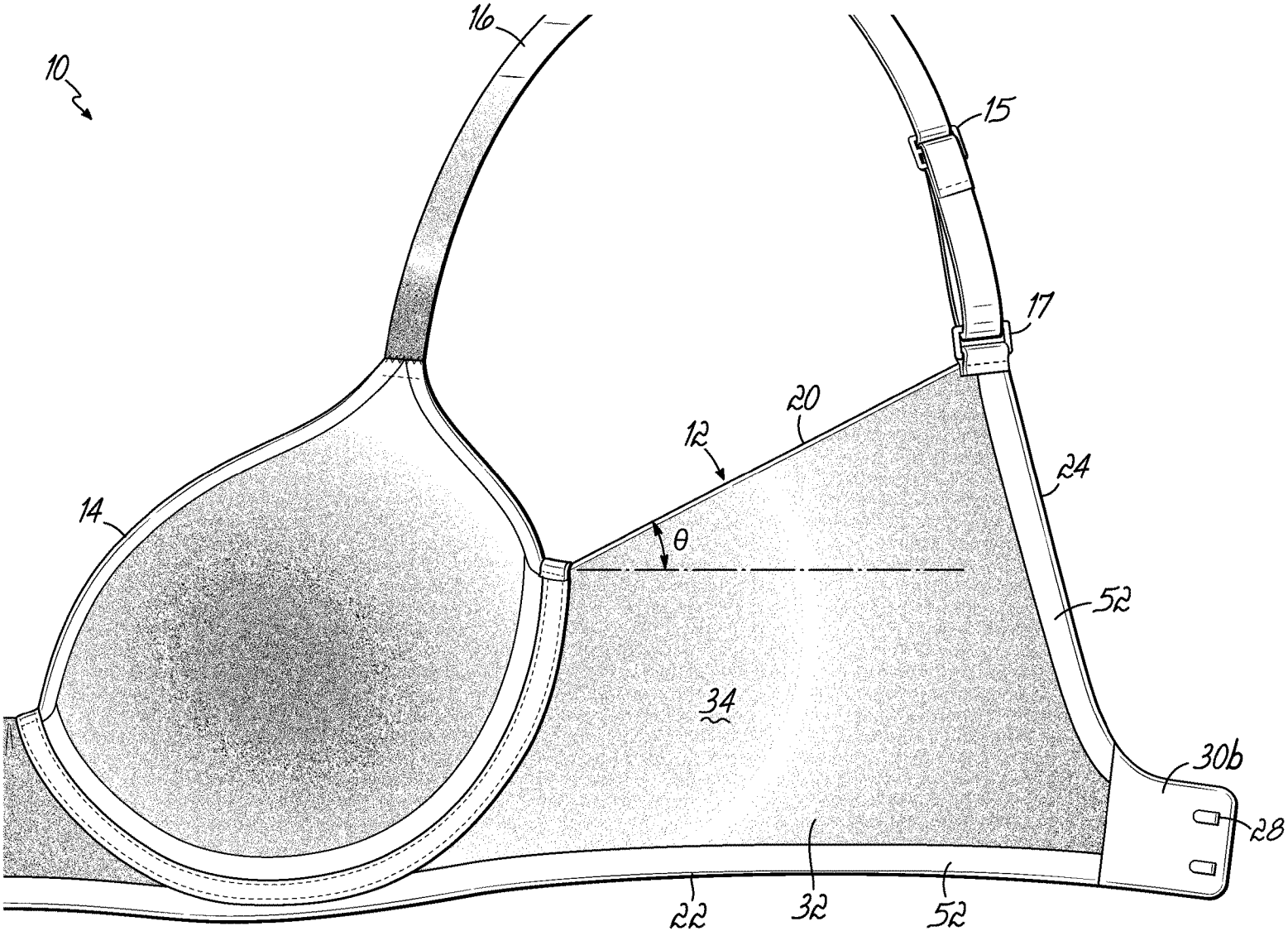
FIG. 5B is a partial, enlarged view of a bra in accordance with an alternative embodiment of the disclosure.
Figure 7:
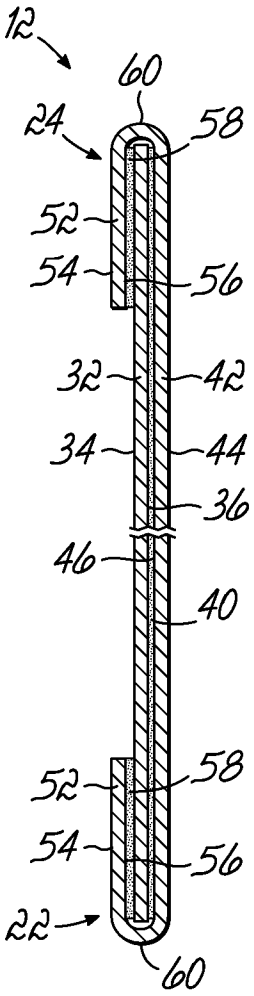
FIG. 7 is a cross-sectional view of the bra of FIG. 5A, highlighting the top and ballet back edges of the bra's wing.
Figure 6:
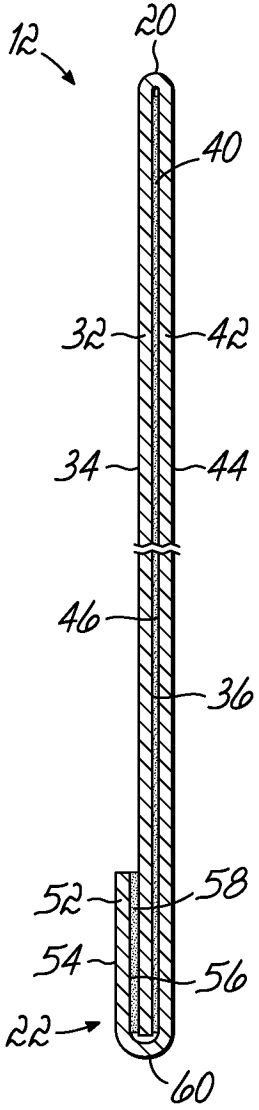
FIG. 6 is a cross-sectional view of the bra of FIG. 5A, highlighting the top and bottom edges of the bra's wing.

FIGS. 5A and 5B are partial, enlarged views of primary and alternate embodiments of the wing 12. Although FIGS. 5A and 5B depict only one portion of the wing 12, namely the rightmost side when viewing the bra from the rear perspective, the forthcoming discussion, including the discussion around FIGS. 6 and 7, is also applicable to the opposite portion of the wing 12, the leftmost side, as the sides of the wing 12 are mirror images of each other notwithstanding the fastener 18. FIGS. 5A and 5B differ primarily in the top wing angle θ, with FIG. 5A depicting a top wing angle θ smaller than in FIG. 5B. Varying the top wing angle θ alters the orientation of the wing fold 20 which in turn alters the proportion of the wing 12 on the body. With an increased on-body proportion for the wing 12, more support and comfort is experienced by the user.

FIGS. 6 and 7 are cross-sectional views of the wing 12. FIG. 6 depicts the wing fold 20 along with the wing bottom hem 22 while FIG. 7 shows the wing ballet back hem 24 along with the wing bottom hem 22. In reference to FIG. 6, the single fabric 2-ply construction of the wing 12 is readily apparent. As previously mentioned, folding the fabric to create the wing fold 20 also creates the inner fabric layer 32 and the outer fabric layer 42. Each fabric layer is further characterized with respective external and internal surfaces—the inner fabric layer external surface 34 and inner fabric layer internal surface 36 for the inner fabric layer 32, as well as the outer fabric layer external surface 44 and outer fabric layer internal surface 46 for the outer fabric layer 42. A laminate film 40 is applied to the inner fabric layer internal surface 36. The laminate film 40 serves as an adhesive (i.e., fusible glue) to bond the inner fabric layer internal surface 36 to the outer fabric layer internal surface 46 post-creation of the wing fold 20. In addition, the laminate film 40 may provide a smoothing effect to the fabric layers. The resulting 2-ply structure in conjunction with the wing fold 20 provides sufficient structural integrity to the wing 12 that the upper portions of the wing 12, the areas denoted by the wing fold 20, are able to remain seamless. In addition, the laminate film 40 may provide a stretch and recovery ability to the wing 12. Alternative embodiments of the invention may substitute the laminate film 40 with another bonding solution to join the two fabric layers while maintaining the same desired effect.

Importantly, when the fabric for the wing 12 is folded to create the wing fold 12, the fabric ends that are distal to the wing fold 20 are not in line. Instead, the distal end of the outer fabric layer 42 extends past the distal end of the inner fabric layer 32 to create an overhang, namely outer fabric layer overhang 52. In alternative embodiments, the distal end of the inner fabric layer 32 may extend past the distal end of the outer fabric layer 42 to create the overhang. This overhang is used to create the wing bottom hem 22 and the wing ballet back hem 24. The overhang 52 may be sized to create hems ranging in size from 8 mm to 10 mm.

As shown in FIGS. 6 and 7, both the wing bottom hem 22 and the wing ballet back hem 24 are comprised of the outer fabric layer overhang 52, which has an overhang external surface 54 and overhang internal surface 56, and a hem fold 60. The overhang internal surface 56 is joined to a portion of the inner fabric layer external surface 34 with an adhesive film 58. An adhesive film tape, such as those made available by Bemis™ may be used for the adhesive film 58. In alternative embodiments, where the outer fabric layer overhang 52 is based on the inner fabric layer 32, the wing bottom hem 22 and the wing ballet back hem 24 can be mirror images of the preferred embodiment. Namely, that an inner fabric layer overhang (not shown) folds over and joins to the outer fabric layer 42 at the outer fabric layer external surface 44.

Those skilled in the art will appreciate that other modifications and variations can be made without departing from the spirit or scope of the invention. Since modifications, combinations, sub-combinations, and variations of the disclosed embodiments incorporating the spirit and substance of the invention may occur to persons skilled in the art, the invention should be construed to include everything within the scope of the appended claims and their equivalents.

What is claimed is:

1. A bra wing, comprising:
a base material;
a fold edge;
a bonding material;
a top edge along an upper perimeter of the bra wing;
a bottom edge along a lower perimeter of the bra wing;
a back edge along side perimeters of the bra wing;
an overhang along the bottom edge; and
an overhang along the back edge,
wherein the fold edge is the top edge,
wherein a fold in the base material creates the fold edge, an inner base material layer having an internal surface, and an outer base material layer having an internal surface,
wherein the internal surface of the inner base material layer is joined directly to the internal surface of the outer base material layer with the bonding material,
wherein the bonding material covers substantially all of the internal surface of the inner base material layer and substantially all of the internal surface of the outer base material layer,
wherein the overhang along the bottom edge is a portion of the outer base material layer extending beyond the inner base material layer at the bottom edge, and
wherein the overhang along the back edge is a portion of the outer base material layer extending beyond the inner base material layer at the back edge.

2. The bra wing of claim 1, wherein the bottom edge is hemmed using the overhang along the bottom edge; and
wherein the back edge is hemmed using the overhang along the back edge.

3. The bra wing of claim 1, wherein the base material is a fabric.

4. The bra wing of claim 1, wherein the bonding material is a film adhesive.

5. The bra wing of claim 1, further comprising a fastening mechanism for securing the bra wing.

6. The bra wing of claim 5, wherein the fastening mechanism is a hook and eye fastener.

7. A bra, comprising:
the bra wing of claim 1;
a first cup; and
a second cup.

8. The bra of claim 7, further comprising two straps.

9. A method of constructing a bra wing from a base material and a bonding material, the method comprising:

folding the base material to create a fold edge, a top edge along an upper perimeter, a bottom edge along a lower perimeter, a back edge along side perimeters, an overhang along the bottom edge, an overhang along the back edge, an inner base material layer having an internal surface, and outer base material layer having an internal surface, wherein the fold edge is the top edge; and joining the internal surface of the inner base material layer directly to the internal surface of the outer base material layer with the bonding material to create a 2-ply structure, wherein the bonding material covers substantially all of the internal surface of the inner base material layer and substantially all of the internal surface of the outer base material layer, wherein the overhang along the bottom edge is a portion of the outer base material layer extending beyond the inner base material layer at the bottom edge, and wherein the overhang along the back edge is a portion of the outer base material layer extending beyond the inner base material layer at the back edge.

10. The method of constructing the bra wing from claim 9, the method further comprising:

removing a first portion of the 2-ply structure along the fold edge sized to receive a first cup; and removing a second portion of the 2-ply structure along the fold edge sized to receive a second cup.

11. The method of constructing the bra wing from claim 10, the method further comprising:

hemming the bottom edge and the back edge; and attaching a fastening mechanism.

12. A bra wing, comprising:

a base material;

a fold edge;

a bonding material;

a top edge along an upper perimeter of the bra wing;

a bottom edge along a lower perimeter of the bra wing;

a back edge along side perimeters of the bra wing;

an overhang along the bottom edge; and an overhang along the back edge, wherein the fold edge is the top edge, wherein a fold in the base material creates the fold edge, an inner base material layer having an internal surface, and an outer base material layer having an internal surface, wherein the internal surface of the inner base material layer is joined directly to the internal surface of the outer base material layer with the bonding material, wherein the bonding material covers substantially all of the internal surface of the inner base material layer and substantially all of the internal surface of the outer base material layer, wherein the overhang along the bottom edge is a portion of the inner base material layer extending beyond the outer base material layer at the bottom edge, and wherein the overhang along the back edge is a portion of the inner base material layer extending beyond the outer base material layer at the back edge.

13. The bra wing of claim 12, wherein the bottom edge is hemmed using the overhang along the bottom edge; and wherein the back edge is hemmed using the overhang along the back edge.

14. The bra wing of claim 12, wherein the base material is a fabric.

15. The bra wing of claim 12, wherein the bonding material is a film adhesive.

16. The bra wing of claim 12, further comprising a fastening mechanism for securing the bra wing.

17. The bra wing of claim 16, wherein the fastening mechanism is a hook and eye fastener.

18. A bra, comprising:

the bra wing of claim 12;

a first cup; and a second cup.

19. The bra of claim 18, further comprising two straps.

20. A method of constructing a bra wing from a base material and a bonding material, the method comprising:

folding the base material to create a fold edge, a top edge along an upper perimeter, a bottom edge along a lower perimeter, a back edge along side perimeters, an overhang along the bottom edge, an overhang along the back edge, an inner base material layer having an internal surface, and outer base material layer having an internal surface, wherein the fold edge is the top edge; and joining the internal surface of the inner base material layer directly to the internal surface of the outer base material layer with the bonding material to create a 2-ply structure, wherein the bonding material covers substantially all of the internal surface of the inner base material layer and substantially all of the internal surface of the outer base material layer, wherein the overhang along the bottom edge is a portion of the inner base material layer extending beyond the outer base material layer at the bottom edge, and wherein the overhang along the back edge is a portion of the inner base material layer extending beyond the outer base material layer at the back edge.

* * * * *